United States Patent [19]

Baker

[11] 3,941,983

[45] Mar. 2, 1976

[54] OMEGA-VOR/DME POSITIONAL DATA COMPUTER FOR AIRCRAFT

[75] Inventor: Donald H. Baker, Phoenix, Ariz.

[73] Assignee: Sperry Rand Corporation, New York, N.Y.

[22] Filed: Jan. 27, 1975

[21] Appl. No.: 544,105

[52] U.S. Cl...... 235/150.27; 235/150.2; 343/112 C

[51] Int. Cl.[2] ..... G06G 7/78

[58] Field of Search..... 235/150.2, 150.26, 150.27, 235/150.272; 343/103, 105 R, 112 R, 112 C

[56] References Cited

UNITED STATES PATENTS

| | | | |
|---|---|---|---|
| 3,070,796 | 12/1962 | Gray | 235/150.272 X |
| 3,103,579 | 9/1963 | Green | 235/150.27 |
| 3,308,278 | 3/1967 | Davis et al. | 235/150.27 |
| 3,739,383 | 6/1973 | Perot et al. | 235/150.27 X |

*Primary Examiner*—Malcolm A. Morrison
*Assistant Examiner*—Jerry Smith
*Attorney, Agent, or Firm*—Howard P. Terry; Albert B. Cooper

[57] ABSTRACT

Apparatus for combining positional data from OMEGA and VOR/DME radio navigation systems to provide computed positional data corresponding thereto includes a circuit for generating an OMEGA compensation in accordance with the difference between the computed value of the positional data and the VOR/DME value thereof. The computed value is provided by algebraically adding the OMEGA compensation to the positional data from the OMEGA system. The gain of the OMEGA compensation circuit is adjusted in an inverse relation with respect to the range of the aircraft from the VOR/DME station thus providing high accuracy positional data throughout the enroute flight of the aircraft without the attendant complexities and inaccuracies normally associated with the separate OMEGA and VOR/DME radio navigation aids.

5 Claims, 4 Drawing Figures

OMEGA-VOR/DME POSITIONAL DATA COMPUTER FOR AIRCRAFT

BACKGROUND OF THE INVENTION

1. Field of the Invention

The invention relates to aircraft radio based area navigation (RNAV) and particularly with regard to OMEGA and VOR/DME RNAV aids.

2. Description of the Prior Art

VOR/DME radio navigation aids are utilized to provide latitude and longitude positional data to aircraft equipped with suitable RNAV receivers. A VOR/DME station utilizes a conventional VOR transmission system to provide bearing data to the aircraft with regard to the station location as well as a standard DME system to provide distance data to the aircraft with regard to the station. Analog and/or digital equipment on board the aircraft converts the bearing and distance data with respect to the fixed location of the station into aircraft latitude and longitude positional data in a well known manner.

The positional data provided by the VOR/DME RNAV aid is accurate when the aircraft is relatively close to the VOR/DME station but the accuracy deteriorates at substantial distances from the station. Such systems provide accuracies of several tenths of a mile within approximately ten miles of a station but have an error of from five to ten miles at distances of 100 to 200 miles from the facility. An error no greater than approximately two miles is desired throughout the enroute flight of the aircraft to permit reduction of air route lane widths.

Previous attempts at enhancing enroute accuracy have involved the use of dual separated DME systems. Although more accurate than the VOR/DME system at significant distances from the stations, the DME/DME system requires two complete DME receivers (A DME receiver being more complex than a VOR receiver) as well as a significantly more complex way point or leg definition based on the two DME stations which provide range vectors with a significant angle with respect to each other as compared to the substantially simpler VOR/DME navigation system. Alternatively, inertial navigation equipment with radio update when the aircraft is close to a station has been used in navigation systems but inertial navigation equipment is extremely expensive compared to the simpler radio systems.

As is known, OMEGA is a low frequency hyperbolic navigation system providing latitude and longitude positional data throughout the world. The OMEGA system achieves one to two mile accuracy but OMEGA receivers require elaborate equipment to correct for propagation effects in order to achieve this accuracy, such propagation effects typically being of a slowly varying diurnal nature.

SUMMARY OF THE INVENTION

The present invention has a principal object to provide accurate positional data from a VOR/DME radio receiver and a basic OMEGA receiver without the elaborate propagation correction equipment.

This object is achieved by an OMEGA-VOR/DME positional data computer that provides a computed positional data signal in response to corresponding OMEGA and VOR/DME positional data signals. The computer includes a circuit for providing an OMEGA compensation which is algebraically added to the OMEGA positional data signal to provide the computed positional data signal. The OMEGA compensation is derived in accordance with the difference between the VOR/DME positional data and the computed positional data. The gain of the OMEGA compensation circuit is controlled in an inverse relationship with regard to the range of the aircraft from the VOR/DME station.

DESCRIPTION OF THE PREFERRED EMBODIMENT

Figure 1:
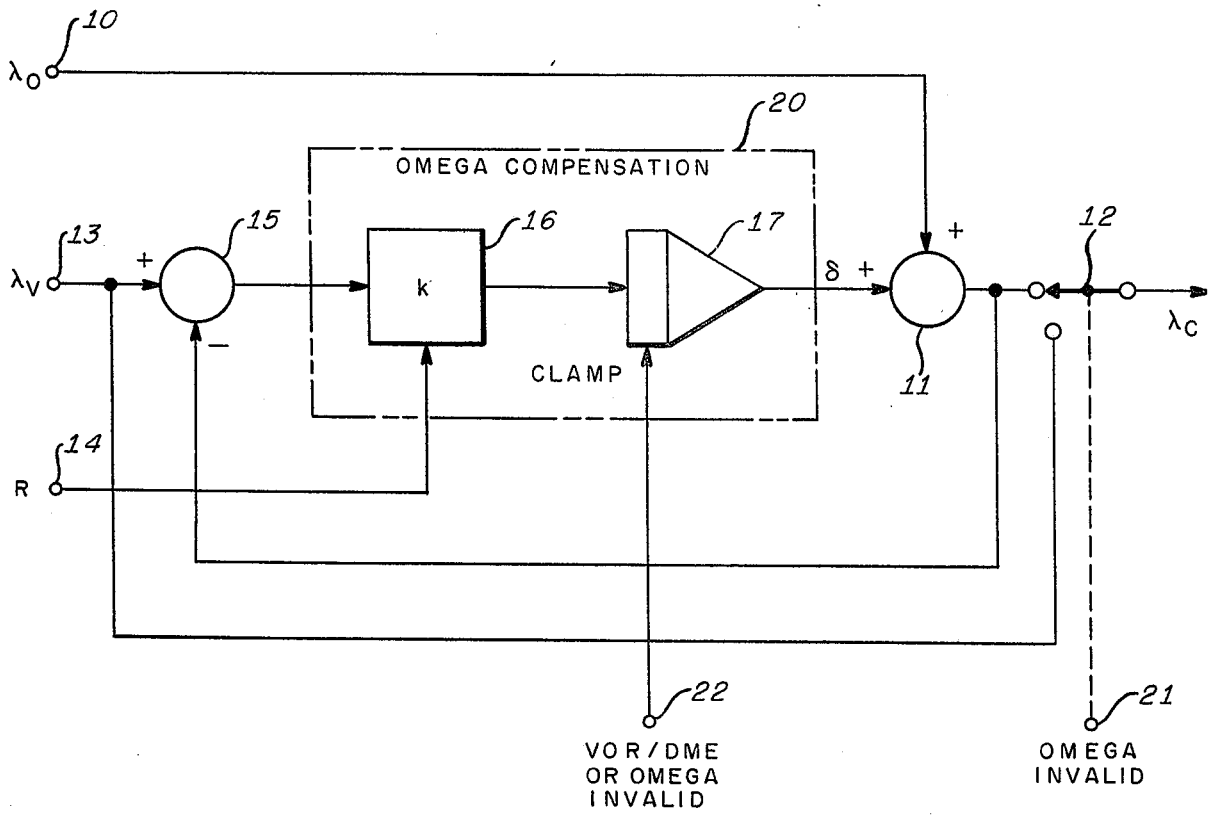
FIG. 1 is a schematic block diagram of an OMEGA-VOR/DME positional data computer instrumented in accordance with the invention.

Referring to FIG. 1, a schematic block diagram of an OMEGA-VOR/DME positional data computer is illustrated. The computer is disclosed in terms of a latitude computation. It will be appreciated that the longitude computation is performed in identically the same manner. The latitude positional data from the OMEGA equipment is applied to a terminal 10 and is designated $\lambda_o$. The $\lambda_o$ data is derived from a basic OMEGA radio receiver and is processed in any convenient and well known manner into the proper format for application to the computer of FIG. 1. The latitude data at the terminal 10 is applied as an input to a summing circuit 11 whose output is applied through a two-position switch 12 to provide the computed latitude output $\lambda_c$ of the computer.

The latitude positional data from the VOR/DME system is applied to a terminal 13 and is designated $\lambda_r$. The $\lambda_r$ data is derived from the VOR/DME system in any convenient and well known manner to provide signals of the appropriate format to the computer of FIG. 1. In a similar manner, the DME equipment provides an appropriate range signal R to a terminal 14 in accordance with the range of the aircraft from the VOR/DME facility to which the aircraft equipment is tuned. The $\lambda_r$ data at the terminal 13 is applied as an input to a summing circuit 15. The output of the summing circuit 11 is applied subtractively as another input to the summing circuit 15. The output of the summing circuit 15 is applied through a gain block 16 as the input to an integrator 17. The range signal at the terminal 14 is applied as another input to the block 16 to control the gain thereof. The gain of the block 16, designated as k, is controlled to have an inverse functional relationship with regard to the range from the aircraft to the VOR/DME facility. The gain k may be inversely proportional to distance or may vary in some other fashion than inversely proportional to distance. For example, the gain k may vary inversely with the square or cube of the range R for reasons to be later discussed. The block 16 is instrumented in any conventional manner to perform the desired function. For example, when the gain k is designed to vary inversely proportional to R, the block 16 may be instrumented as a multiplier and a circuit for taking the reciprocal of R.

The multiplier would then multiply the output from the summing circuit 15 by the reciprocal of R thereby providing the inversely proportional relationship. Similar gain circuits are disclosed in co-pending U.S. patent application Ser. No. 465,228, filed Apr. 29, 1974 in the names of D. H. Baker and L. J. Bowe, entitled "Radio Navigation System", and assigned to the assignee of the present invention.

The gain block 16 and the integrator 17 comprise an OMEGA compensation circuit 20 for providing an OMEGA compensation signal designated as $\delta$. The OMEGA compensation signal $\delta$ from the integrator 17 is applied as an input to the summing circuit 11.

When the OMEGA receiver is inative or the OMEGA data is invalid a signal is applied from the OMEGA receiver (not shown) to a terminal 21 to position the switch 12 to the contact opposite that illustrated in FIG. 1. When so positioned the $\lambda_c$ output is connected directly to the terminal 13 for reasons to be discussed. The OMEGA invalid signal is also applied to a terminal 22 to clamp the integrator 17 for reasons to be discussed. In a similar manner when the VOR/DME equipment is inactive or the VOR/DME data is invalid the integrator 17 is again clamped via the appropriate invalid signal applied to the terminal 22.

It will be appreciated from FIG. 1 that $$\lambda_c = \lambda_o + \delta \tag{1}$$

and that $$\delta = \int k(\lambda_r - \lambda_c)dt \tag{2}$$

Substituting equation (2) into equation (1) yields $$\lambda_c = \lambda_o + \int k(\lambda_r - \lambda_c)dt \tag{3}$$

And taking the derivative with respect to time yields $$\lambda^\circ_c = \lambda^\circ_o + k(\lambda_r - \lambda_c) \tag{4}$$

Regrouping the terms yields $$\lambda^\circ_c + k\lambda_c = \lambda^\circ_o + k\lambda_r. \tag{5}$$

It is therefore appreciated that if k is very large ($k\lambda >> \lambda^\circ$), then $\lambda_c$ will tend to track $\lambda_r$, the VOR/DME derived latitude. If k is very small ($k\lambda << \lambda^\circ$), then $\lambda_c$ will tend to track $\lambda_o$. The first condition is desirable near a VOR/DME facility where the VOR accuracy is high. The second condition is desirable at large distances where OMEGA is significantly more accurate than VOR. Consequently, $k$ is made to vary inversely with respect to the distance R from the aircraft to the VOR/DME facility, e.g., inversely proportional with respect thereto as follows:

$$k = k_1/R \tag{6}$$

where $k_1$ is a constant.

Substituting equation (6) into equation (3) yields $$\lambda_c = \lambda_o + k_1 \int \frac{(\lambda_r - \lambda_c)}{R} dt \tag{7}$$

Thus it is appreciated that with the appropriate instrumentation for the block 16 as described above, equation (7) describes the implementation of the OMEGA-VOR/DME positional data computer of FIG. 1.

In operation when the VOR/DME and the OMEGA data are valid, the switch 12 is positioned as illustrated in FIG. 1 and the integrator 17 is unclamped. When the aircraft is relatively near a VOR/DME facility, the gain through the block 16 is adjusted to be high and therefore the computer of FIG. 1 rapidly forces the output $\delta$ from the integrator 17 to be equal to the difference between the OMEGA derived data at the terminal 10 and the VOR/DME derived data at the terminal 13. Thus the term $\delta$ is a compensation that is added to the OMEGA data by means of the summing circuit 11 to provide the computed data $\lambda_c$ which at close proximity to a VOR/DME facility is equal to the accurate $\lambda_r$ data. As the aircraft departs from the vicinity of a VOR/DME station, the gain through the block 16 is diminished. When the aircraft is at a substantial distance from the VOR/DME station the gain through the block $k$ is small so that the inaccuracies of the $\lambda_r$ data at the large enroute distances from the VOR/DME facility have a diminished effect on the value of the OMEGA compensations $\delta$ stored in the integrator 17. Thus it is appreciated that although the accuracy of the $\lambda_r$ data has deteriorated, the value of the OMEGA compensation $\delta$ that is added to the OMEGA data $\lambda_o$ still retains the accuracy accumulated when the aircraft was near the VOR/DME station because of the decoupling effect of the diminished gain through the block 16. It will be appreciated that although an inversely proportional relationship as discussed above with regard to the block 16 will provide adequate decoupling, the scale factor k utilized in determining the relative authorities of the OMEGA and the VOR/DME data may be varied in some other fashion than inversely proportional to distance. For example, $k$ may be varied inversely with the square or cube of the distance to more sharply decouple the OMEGA data at long distances from the VOR/DME facility. In the event of failure of the VOR/DME equipment which invalidates the associated data or in the event of momentary interruption of the VOR/DME data such as when tuning to a new station, a signal on the lead 22 clamps the integrator 17, thus fixing the presently stored value of the OMEGA compensation $\delta$. Thus the OMEGA data $\lambda_o$ at the terminal 10 continues to be properly compensated by the fixed value of $\delta$ which is the last valid value thereof.

Similarly, when the OMEGA data $\lambda_o$ is invalid, a signal at the terminal 22 again clamps the integrator 17 and a signal at the terminal 21 transfers the wiper of switch 12 to the position opposite that illustrated in FIG. 1 to connect the output $\lambda_c$ directly to the VOR/DME data $\lambda_r$ at the terminal 13. Alternatively storage means (not shown) may be utilized to store the latest value of $\lambda_o$ to be utilized in the event of a failure in the OMEGA data. The integrator 17 is clamped when the OMEGA data fails to preserve the last valid value of the OMEGA compensation $\delta$ for use when the system is again functioning properly.

When both the VOR/DME and the OMEGA data are invalid, the output of the computer of FIG. 1 may be switched by means not shown to dead reckoning equipment such as that disclosed in the aforesaid Ser. No. 465,228.

It will be appreciated from the foregoing that the computer of FIG. 1 utilizes complementary mixing of the OMEGA and VOR/DME data to combine the desirable characteristics of each navigation source to provide high accuracy enroute latitude and longitude positional data while not requiring complex OMEGA propagation corrections. Thus a simple OMEGA receiver is utilized without the usual highly complex electronic circuitry for correcting the diurnal errors associated with OMEGA transmissions. It will furthermore be appreciated that the elements of FIG. 1 may be either analog or digital components with appropriately configured signals being applied to the terminals 10, 13 and 14, suitable conventional signal conversion being utilized when necessary.

Figure 2:
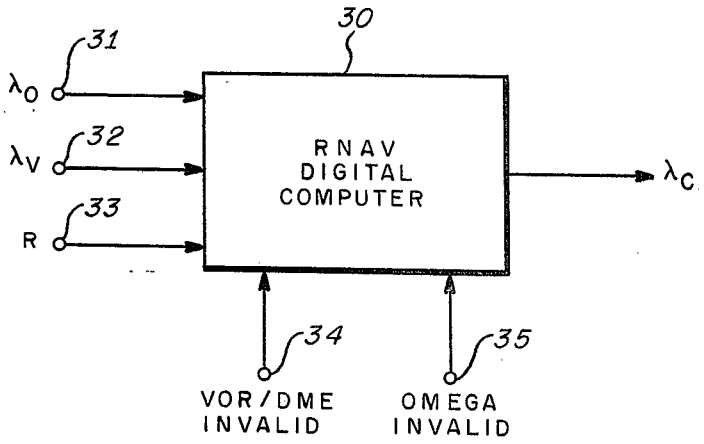
FIG. 2 is a schematic block diagram of an OMEGA-VOR/DME positional data computer instrumented in accordance with the invention with a digital computer.

The computer of FIG. 1 was described in terms of discrete analog or digital components. It will be appreciated that the present invention may be embodied by a programmed digital computer for implementing the functions of the present invention represented, for example, by equation (7). Referring now to FIG. 2, a stored program digital computer is schematically represented at 30 having the OMEGA positional data $\lambda_o$, the VOR/DME positional data $\lambda_r$ and the range of the aircraft to the VOR/DME facility R applied at terminals 31, 32 and 33 respectively. The computer 30 is programmed in a manner to be described to provide the computed positional data $\lambda_c$ as indicated by the legend. The embodiment of FIG. 2 may operate in failure modes in a manner similar to that described above with regard to FIG. 1 in response to a VOR/DME invalid signal at a terminal 34 and an OMEGA invalid signal at a terminal 35. It will be appreciated that signals of appropriate formats may be applied to the terminals 31–35 or suitable conventional conversion performed thereon by apparatus not shown or by well known programs stored within the computer 30.

Figure 3:
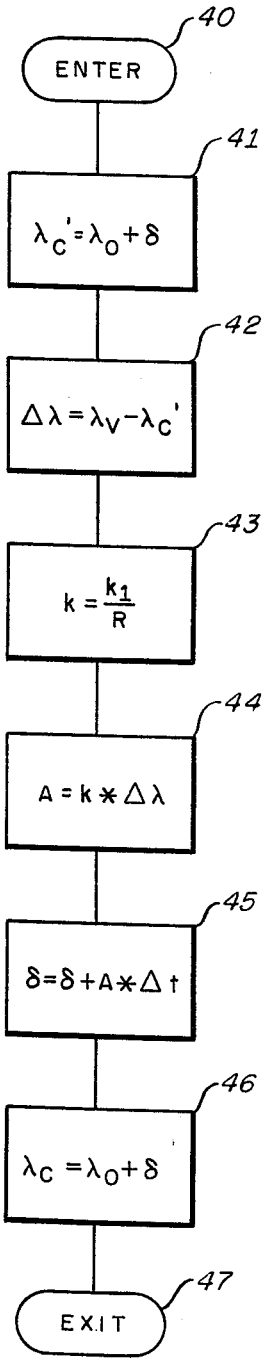
FIG. 3 is a computer program flow diagram for instrumenting the computations with regard to FIG. 2.

Referring now to FIG. 3, the step by step computation of the computed latitude $\lambda_c$ performed by the computer 30 is illustrated. During each computation iteration, the computer enters the computational program flow at 40 by going to the initial address of the computational subroutine as stored in the memory of the computer 30. At block 41 of the flow chart the current value of the OMEGA data $\lambda_o$ is corrected by adding the last stored OMEGA compensation $\delta$ to form a temporary computed latitude $\lambda_c'$. At block 42 $\lambda_c'$ is subtracted from the current value of the VOR/DME latitude to determine the error therebetween $\Delta\lambda$. In block 43 the gain $k$ is computed as a function of the distance R from the VOR/DME facility where $k_1$ is a constant. In block 44 the latitude error $\Delta\lambda$ is multiplied by the gain k to obtain the intergrand A. In block 45 the integration is performed by multiplying the intergrand A by $\Delta t$, the time since the last correction, and adding the result to the previous value of the OMEGA correction $\delta$ to form an updated $\delta$. In block 46 the computed latitude $\lambda_c$ is obtained by adding the updated OMEGA correction $\delta$ to the OMEGA derived latitude $\lambda_o$. Since block 46 completes a computational iteration the program exits at 47.

It will be appreciated that the program segments associated with each of the blocks 40–47 are readily prepared by a normally skilled programmer and will not be shown herein for brevity. It will further more be appreciated that most of the legends within the blocks of FIG. 3 are in the format of program statements of a compiler programming language such as FORTRAN.

Figure 4:
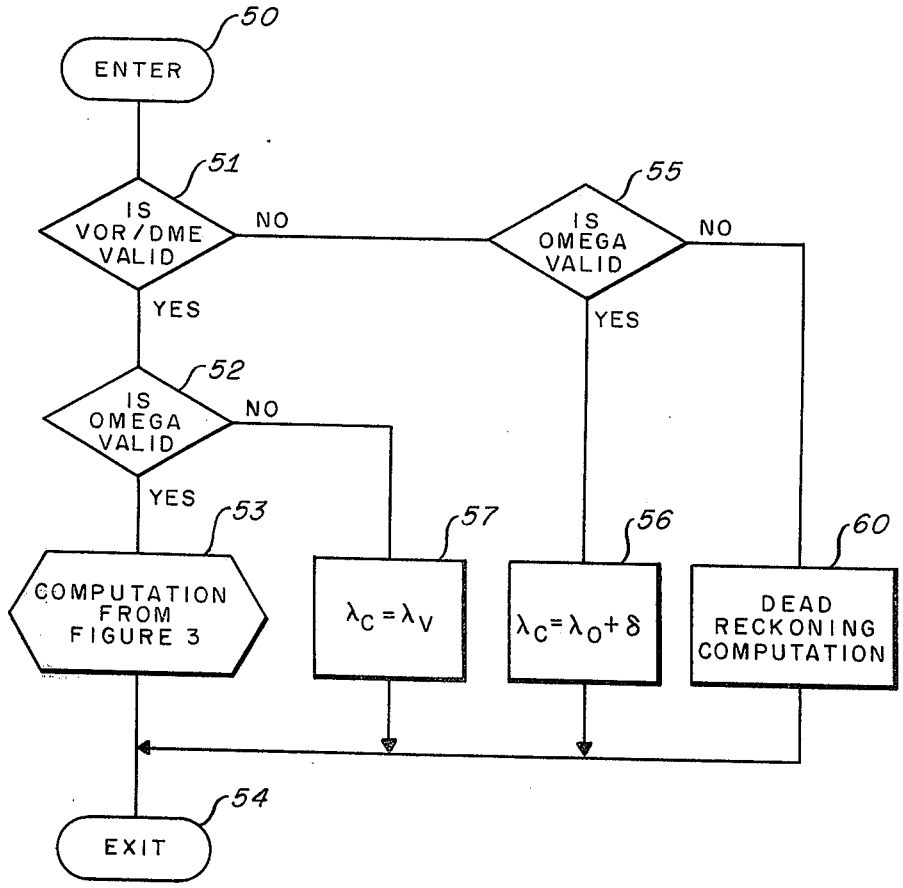
FIG. 4 is a flow diagram for operating the computer of FIG. 2 in failure modes.

Referring now to FIG. 4, a flow chart for the operation of the embodiment of FIG. 2 in failure modes is illustrated. The program enters at 50 and at 51 tests the state of the signal applied to the terminal 34 to determine if the VOR/DME data is valid. If the data is valid the program proceeds to block 52 to similarly test the validity of the OMEGA data in response to the signal at the terminal 35. If both the VOR/DME and the OMEGA data are valid the program proceeds to the block 53 wherein the computations discussed with regard to FIG. 3 are performed. Since the computational iteration is then complete, the program exits at 54. If, however, the VOR/DME data is found to be invalid in the block 51, the program proceeds to a block 55 which is similar to the block 52 in that the validity of the OMEGA data is tested. If the OMEGA data is valid, although the VOR/DME data is invalid, the program proceeds to a block 56 wherein the computed latitude data $\lambda_c$ is obtained by updating the current and valid OMEGA data $\lambda_o$ with the last computed OMEGA compensation $\delta$. The program then proceeds to the exit block 54. If the program reaches the block 52 and finds the OMEGA data invalid, although the VOR/DME data is valid, the program proceeds to a block 57 that utilizes the VOR/DME data $\lambda_r$ directly to provide the computed data $\lambda_c$ whereafter the program proceeds to the exit block 54. If, however, neither the VOR/DME nor the OMEGA data is valid, the program proceeds through the blocks 51 and 55 to a block 60 wherein dead reckoning computations are performed of the type discussed in the aforesaid patent application Ser. No. 465,228, whereafter the program proceeds to the exit block 54.

It will be appreciated from the foregoing that the present invention utilizes the OMEGA equipment operating in a relatively simple differential mode to provide high enroute accuracy without the necessity for the usual complex and expensive diurnal error correction electronic circuitry. The VOR/DME positional data is given an authority which is an inverse function of the distance from the station. Within approximately ten miles from the station the VOR/DME data is strongly used to update the OMEGA data. At large distances the OMEGA data displacement from the last update is utilized to provide the computed position with high accuracy and without propagation corrections.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. A computer for use in aircraft for providing a computed positional data signal in response to an OMEGA positional data signal from an OMEGA system, a VOR/DME positional data signal from VOR/DME apparatus tuned to a stationary VOR/DME facility and a range signal representative of the distance of said aircraft from said VOR/DME facility, comprising:

first summing means responsive to said VOR/DME positional data signal and said computed positional data signal for providing a positional data error signal representative of the difference therebetween, OMEGA compensation means responsive to said positional data error signal and said range signal for providing an OMEGA compensation signal with a dependance on said positional data error signal in accordance with an inverse function of said distance, and second summing means responsive to said OMEGA positional data signal and said OMEGA compensation signal for providing said computed positional data signal in accordance with the algebraic sum thereof.

2. The computer of claim 1 in which said OMEGA compensation means comprises:

gain adjusting means responsive to said positional data error signal and said range signal for providing said positional data error signal at a gain adjusted in accordance with said inverse function of said distance, and integrator means coupled to said gain adjusting means for providing said OMEGA compensation signal in accordance with the integral of said gain adjusted positional data error signal.

3. The computer of claim 2 further including means for clamping said integrator in response to a signal indicative of invalidity of said VOR/DME positional data signal.

4. The computer of claim 2 further including means for obtaining said computed positional data signal directly from said VOR/DME positional data signal in response to a signal indicative of invalidity of said OMEGA positional data signal.

5. A computer for use in aircraft for providing a computed positional data signal in response to an OMEGA positional data signal from an OMEGA system, a VOR/DME positional data signal from VOR/DME apparatus tuned to a stationary VOR/DME facility and a range signal representative of the distance of said aircraft from said VOR/DME facility, comprising:

means for storing a previous value of an OMEGA compensation signal, first means for adding the current value of said OMEGA positional data signal to said previous value of said OMEGA compensation signal to provide a temporary computed positional data signal, second means for subtracting the value of said temporary computed positional data signal from the current value of said VOR/DME positional data signal to provide a positional data error signal, third means for computing a gain value in accordance with an inverse function of said distance, fourth means for multiplying the value of said positional data error signal by said gain value to provide an intergrand value, fifth means for multiplying said intergrand value by the time elapsed since the computation for said previous value of said OMEGA compensation signal and for adding the result to said previous value of said OMEGA compensation signal to provide an updated value of said OMEGA compensation signal, thereby performing a time integration of said positional data error signal at a gain determined by said third means, and sixth means for adding said updated value of said OMEGA compensation signal to said current value of said OMEGA positional data signal to provide said computed positional data signal.

* * * * *